US006783385B2

(12) United States Patent
Rudy

(10) Patent No.: US 6,783,385 B2
(45) Date of Patent: Aug. 31, 2004

(54) ELECTRICAL CONNECTOR FOR SECURING A WIRE TO A CONTACT

(75) Inventor: William J. Rudy, Annville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/358,519

(22) Filed: Feb. 5, 2003

(65) Prior Publication Data

US 2004/0152355 A1 Aug. 5, 2004

(51) Int. Cl.[7] ..... H01R 13/648
(52) U.S. Cl. ..... 439/438
(58) Field of Search ..... 439/436, 438, 439/439, 441, 442, 437

(56) References Cited

U.S. PATENT DOCUMENTS 4,416,500 A * 11/1983 Stenz ..... 439/436
4,759,726 A * 7/1988 Naylor et al. ..... 439/441
5,069,638 A * 12/1991 Schalk ..... 439/439
5,494,456 A * 2/1996 Kozel et al. ..... 439/441
5,685,735 A * 11/1997 Hohorst ..... 439/441
5,876,237 A * 3/1999 Patel et al. ..... 439/441
5,915,991 A * 6/1999 Roman ..... 439/441
5,993,270 A * 11/1999 Geske et al. ..... 439/835
6,074,242 A * 6/2000 Stefaniu et al. ..... 439/441
6,126,494 A * 10/2000 Fuchs et al. ..... 439/835
6,146,187 A * 11/2000 Pallai ..... 439/441
6,371,435 B1 4/2002 Landis et al. ..... 248/694

OTHER PUBLICATIONS

Installation Manual for "Allen–Bradley/Rockwell Automation Connector System", p. 6, Rev O, no date.

* cited by examiner

*Primary Examiner*—Tulsidas C. Patel

(57) ABSTRACT

An electrical connector includes a housing holding a contact. The housing has an opening configured to receive a wire to be joined with the contact. The electrical connector includes a clamping member held within the housing. The clamping member is movable between clamped and unclamped states. The electrical connector includes an actuator movably held within the housing. The actuator moves between open and closed positions. The actuator has a clamp seating portion that holds the clamping member in the unclamped state.

20 Claims, 10 Drawing Sheets

ELECTRICAL CONNECTOR FOR SECURING A WIRE TO A CONTACT

BACKGROUND OF THE INVENTION

The present invention generally relates to an electrical connector configured to connect a wire to a contact. More particularly, the present invention relates to an electrical connector that utilizes an actuator and clamping member to secure a wire to a contact.

In many electronics applications, a conductive wire extending from a first electronic component is connected to a conductive contact that engages a second electronic component. FIG. 12 illustrates an exploded view of a conventional electrical connector 8 used to make such an electrical connection. The electrical connector 8 includes a rectangular housing 9 that carries a plurality of spring clamps 11 and contacts 13 within a chamber 15. Each spring clamp 11 has a base piece 17 that is formed with a beam portion 19. The beam portion 19 has a window 27 cut therein that receives a tab 29 extending from an arm portion 23. The tab 29 is moved laterally within the window 27 by flexing the arm portion 23. Each contact 13 has a first end 33 that extends outward from a front end of the housing 9. The first end 33 of the contact 13 may be configured to be electrically connected to an electronic component in a number of ways. A second end 35 of the contact 13 extends into the chamber 15 and into the window 27 near the tab 29.

FIG. 13 illustrates an isometric view of the assembled electrical connector 8. The housing 9 has wire openings 37 that receive stripped wires 45. The wire openings 37 join the chamber 15 (FIG. 12). The housing 9 also includes tooling openings 39 proximate each wire opening 37. An operator inserts a screwdriver 43 into a tooling opening 39 until the tip of the screwdriver is located proximate an elbow 21 (FIG. 12) on the corresponding spring clamp 11 (FIG. 12). The screwdriver 43 is used to pry the elbow 21 such that the beam portion 19 (FIG. 12) and window 27 (FIG. 12) on the spring clamp 11 are deflected laterally with respect to the tab 29. The operator then inserts the wire 45 into the window 27 and removes the screwdriver 43 from the tooling opening 39 to release the spring clamp 11 such that the spring clamp 11 flexes back to its normal resting position. The wire 45 is thus secured to the contact 13 (FIG. 12).

However, the foregoing conventional connector suffers from several drawbacks. To insert the wire into the window properly, the operator must deflect the spring clamp with a screwdriver. To do so, the operator inserts the screwdriver into the tooling opening, aligns the screwdriver with the spring clamp and applies enough force to the spring clamp to open the window for the wire. The operator must then hold the spring clamp in the open position with the screwdriver in one hand while simultaneously inserting the wire into the wire opening with the other hand and properly feeding the wire into the open window in the spring clamp. It is difficult for the operator to coordinate these various functions at the same time to secure properly the wire to the contact.

Also, to release the wire, the operator must again use the screwdriver in one hand to open the spring clamp while removing the wire with the other hand. The operator must perform these two handed operations every time the operator wishes to install or remove wires.

A need exists for an electrical connector that addresses the above noted problems and others experienced heretofore.

BRIEF SUMMARY OF THE INVENTION

Certain embodiments of the present invention include an electrical connector having a housing holding a contact. The housing has an opening configured to receive a wire to be joined with the contact. The electrical connector includes a clamping member held within the housing. The clamping member is movable between clamped and unclamped states. The electrical connector includes an actuator movably held within the housing. The actuator moves between open and closed positions. The actuator has a clamp seating portion that holds the clamping member in the unclamped state.

Certain embodiments of the present invention include an electrical connector having a housing with an opening configured to receive a wire. The electrical connector includes a clamping member located in the housing. The clamping member includes a window movable along a clamping direction between aligned and offset positions with respect to the opening. The electrical connector includes an actuator held in the housing. The actuator is movable between open and closed positions in an actuator direction that is aligned non-parallel with the clamping direction of the clamping member. The actuator moves the window between the aligned and offset positions as the actuator is moved between the open and closed positions, respectively.

Figure 1:
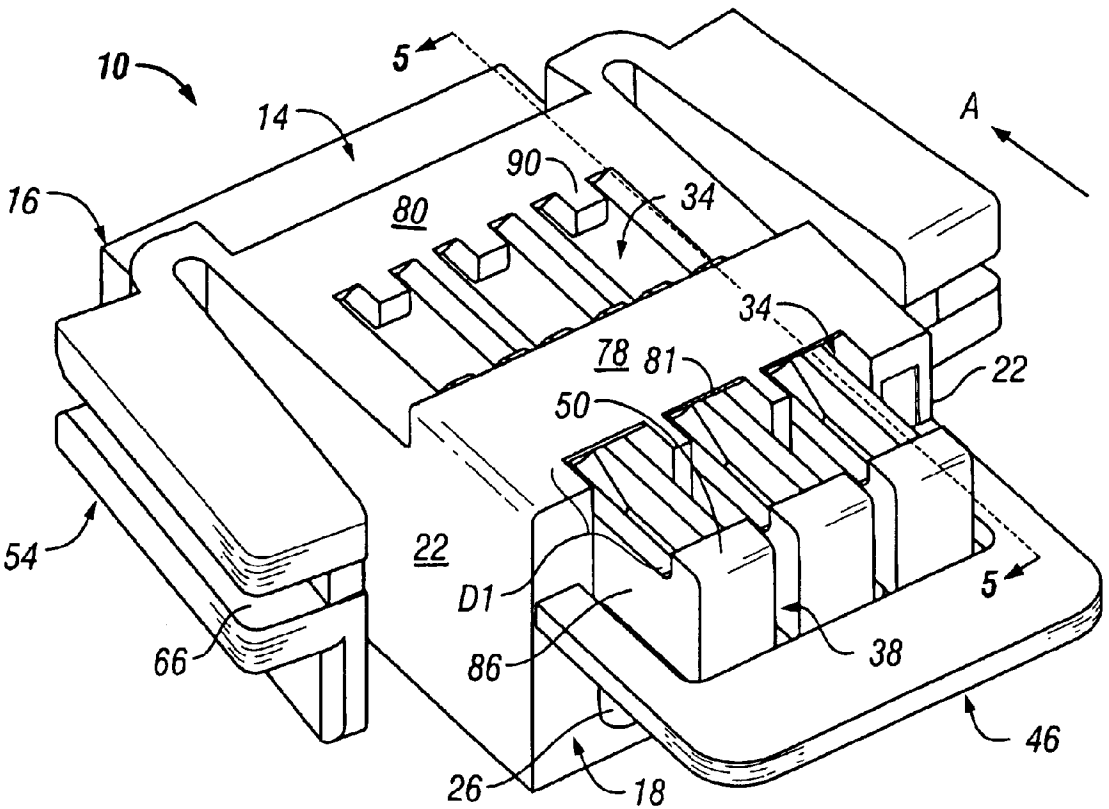
FIG. 1 illustrates an isometric view of an electrical connector formed according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates an isometric view of an electrical connector 10 formed according to an embodiment of the present invention while in an open position. The electrical connector 10 includes a housing 14 having a front end 16, a rear end 18 and side walls 22. The front end 16 is configured to be joined with a mating electronic component. The housing 14 has wire openings 26 extending through the rear end 18 (better shown in FIG. 2). The wire openings 26 receive insulated wires 42 (FIG. 3). The housing 14 also includes channels 34, extending inward from the rear end 18, that slidably receive actuators 38. The channels 34 extend into the housing 14 under a cover 78 and are partially exposed along a top wall 80 of the housing 14. The top wall 80 has channel blocks 90 formed in the channels 34 that engage the actuators 38 when the actuators 38 are moved in the direction of arrow A to an end of the range of motion. The actuators 38 have body portions 86 with outer ends having rectangular stops 50 that extend upward to align with the cover 78. As shown in FIG. 1, when the actuators 38 are in the open position, the stops 50 are located a distance D1 from a rear edge 81 of the cover 78.

A break-off tab 46 may be formed with, and extend from, the housing 14 at the rear end 18. The break-off tab 46 extends around, and is formed with, the actuators 38. The break-off tab 46 holds the actuators 38 in the open position. In operation, once the wires 42 (FIG. 3) are inserted into the wire openings 26, the break-off tab 46 is snapped off of the housing 14 in order that the actuators 38 may be slid in the direction of arrow A into the channels 34 to secure the wires 42 in the housing 14.

Flexible retention arms 54 are joined to the housing 14 proximate the front end 16. The flexible retention arms 54 extend outward in opposite directions from, and form acute angles to, the side walls 22. The retention arms 54 have slots 66 formed along outer sides thereof.

Figure 2:
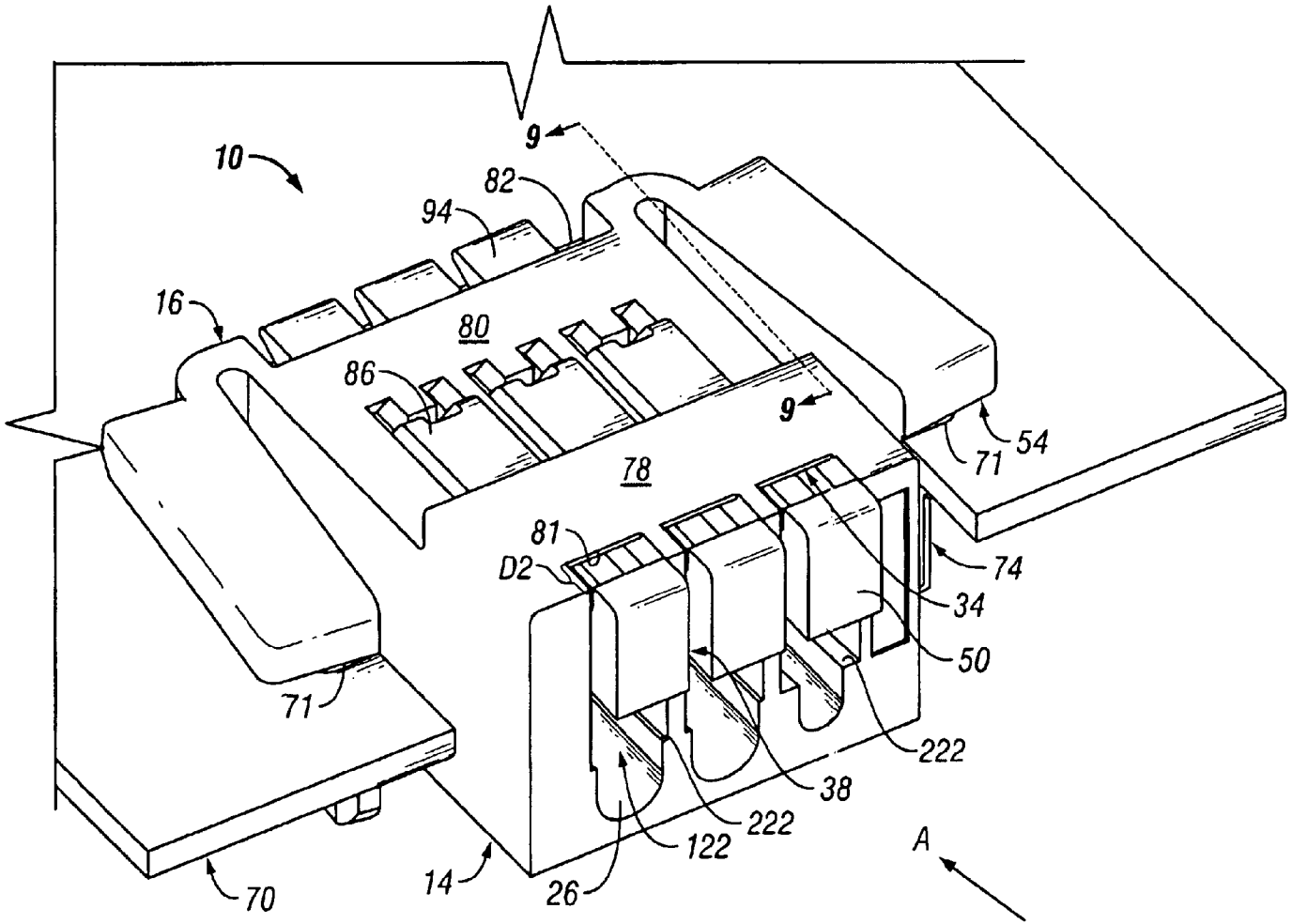
FIG. 2 illustrates an isometric view of an electrical connector retained in a guide plate according to an embodiment of the present invention.
Figure 3:
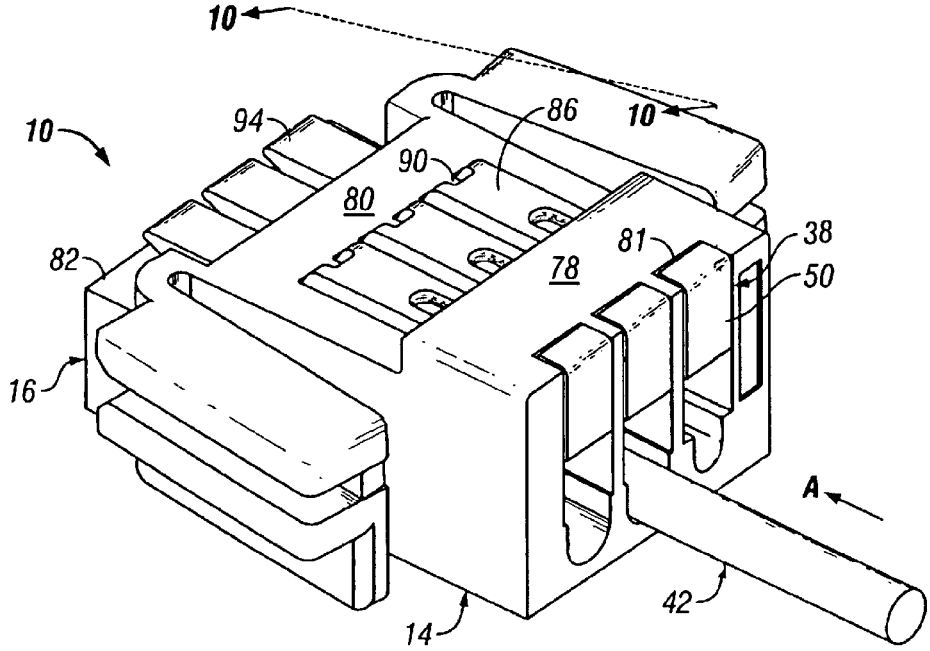
FIG. 3 illustrates an isometric view of an electrical connector carrying a wire according to an embodiment of the present invention.

FIG. 2 illustrates an isometric view of the electrical connector 10 retained in a guide plate 70 of an electronic component (not shown). The guide plate 70 carries the housing 14 on the electronic component. In order to insert the housing 14 into the guide plate 70, one deflects the retention arms 54 inward toward each other until the housing 14 is received in a gap 74 in the guide plate 70. The retention arms 54 are then released to flex back out away from each other with the retention slots 66 (FIG. 1) receiving the guide plate 70 and the retention arms 54 latched into notches 71 formed in the guide plate 70. The retention slots 66 thus hold the housing 14 within the gap 74 of the guide plate 70.

FIG. 2 better illustrates the wire openings 26 which lead into passages 122 having opposed support ledges 222 that support the actuators 38 as the actuators 38 are moved within the channels 34.

FIG. 2 illustrates the actuators 38 in a closed position. The break-off tab 46 (FIG. 1) has been removed from the actuators 38 and the actuators 38 have in turn been inserted into the channels 34 in the direction of arrow A. The body portions 86 of the actuators 38 extend into the channels 34 along the top wall 80. The actuators 38 have fingers 94 that extend beyond the top wall 80 and project over a forward shelf 82 at the front end 16 of the housing 14. The stops 50 are located a distance D2 from the rear edge 81 of the cover 78 when in the closed position. The distance D2 is shorter than the distance D1 (FIG. 1).

FIG. 3 illustrates an isometric view of the electrical connector 10 carrying a wire 42. FIG. 3 illustrates the actuators 38 in a wire repair or release position, at which the stops 50 are moved in the direction of arrow A until abutting against the rear edge 81 of the cover 78. The body portions 86 of the actuators 38 fully extend into the channels 34 (FIG. 2) along the top wall 80 until engaging the channel blocks 90. The fingers 94 on the actuators 38 extend even further beyond the top wall 80 over the forward shelf 82 at the front end 16 of the housing 14.

As shown in FIGS. 1–3, the stops 50 are located different distances from the rear edge 81 of the cover 78 and the actuators 38 are moved along a linear range of motion in an actuator direction between the open, closed, and repair positions. A tool such as a pair of pliers (not shown) may be used (but is not needed) to move the stops 50 from the closed position to the repair position. When the actuators 38 are in the repair position, the wires 42 rest loosely within the wire openings 26 and may be removed.

Figure 4:
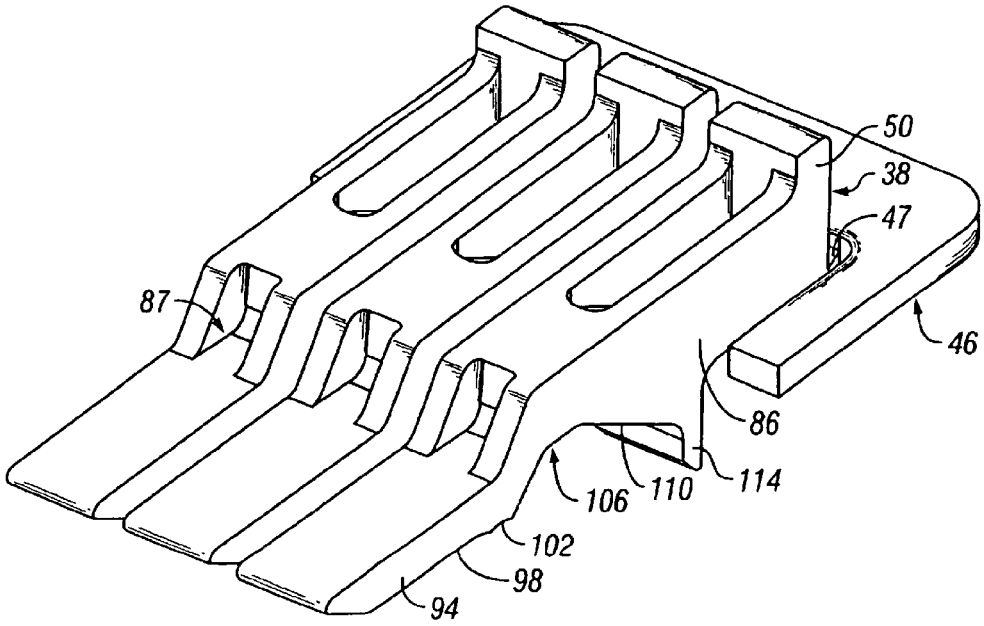
FIG. 4 illustrates an isometric view of actuators and a break-off tab formed according to an embodiment of the present invention.

FIG. 4 illustrates an isometric view of the actuators 38 and the break-off tab 46 to better show the fingers 94 extending from one end of the body portions 86 and the stops 50 projecting upward from an opposite end of the body portions 86. Each actuator 38 has a lower surface 98 that extends along the finger 94 and joins a concave, curved seat 102 that is located adjacent to a notched out portion 106. The notched out portion 106 includes a ramped surface 110 located remote from the seat 102. The ramped surface 110 joins a wire guide 114 which projects perpendicularly downward from the body portion 86. The wire guide 114 slides along the support ledges 222 (FIG. 2). The body portion 86 includes a notch 87 facing forward to receive the corresponding channel block 90 (FIG. 3). The break-off tab 46 is connected at stubs 47 to the actuators 38 proximate the stops 50. Optionally, the seat 102 may not be concaved, but instead may be flat or even convex.

Figure 5:
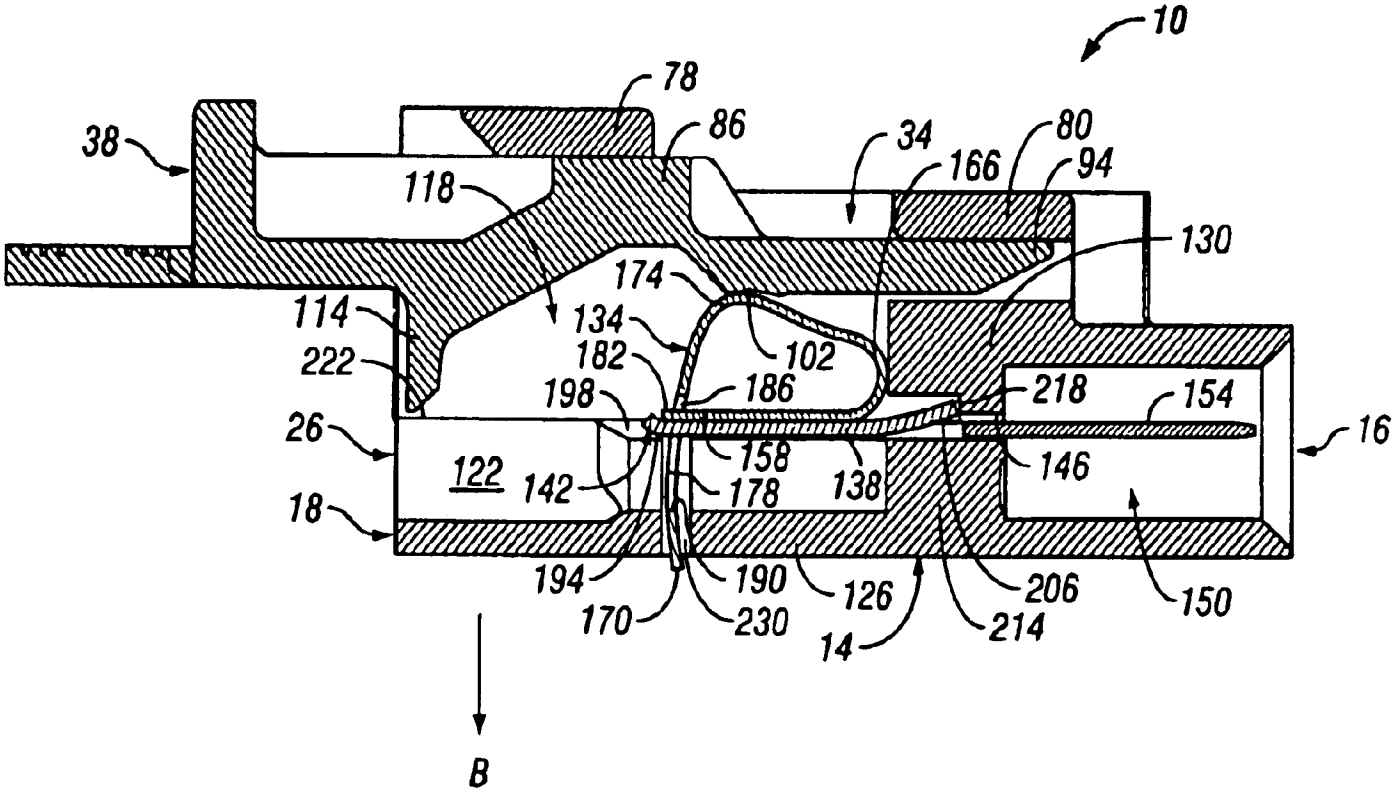
FIG. 5 illustrates a cross sectional view of the electrical connector of FIG. 1 taken along section line 5—5 in FIG. 1.

FIG. 5 illustrates a cross sectional view of the electrical connector 10 of FIG. 1 taken along section line 5—5 in FIG. 1. The housing 14 includes a chamber 118 that communicates with the wire opening 26 through the passage 122. The chamber 118 receives a corresponding actuator 38 in an orientation such that the body portion 86 slidably moves back and forth below the cover 78. The wire guide 114 is located proximate the rear end 18 of the housing 14 to close one side of the wire opening 26. The finger 94 extends through the channel 34 to a point below the top wall 80.

The chamber 118 also receives a contact 138 and a compressible clamping member, such as a spring clamp 134. The spring clamp 134 abuts the contact 138. The chamber 118 has a support ledge 198 that supports a first end 142 of the contact 138. The contact 138 extends through a hole 146 in an interior wall 130 of the housing 14. A second end 154 of the contact 138 projects into a connection cavity 150 proximate the front end 16 of the housing 14. The second end 154 of the contact 138 is configured to join a socket in an electronic component (not shown) within the connection cavity 150.

Figure 6:
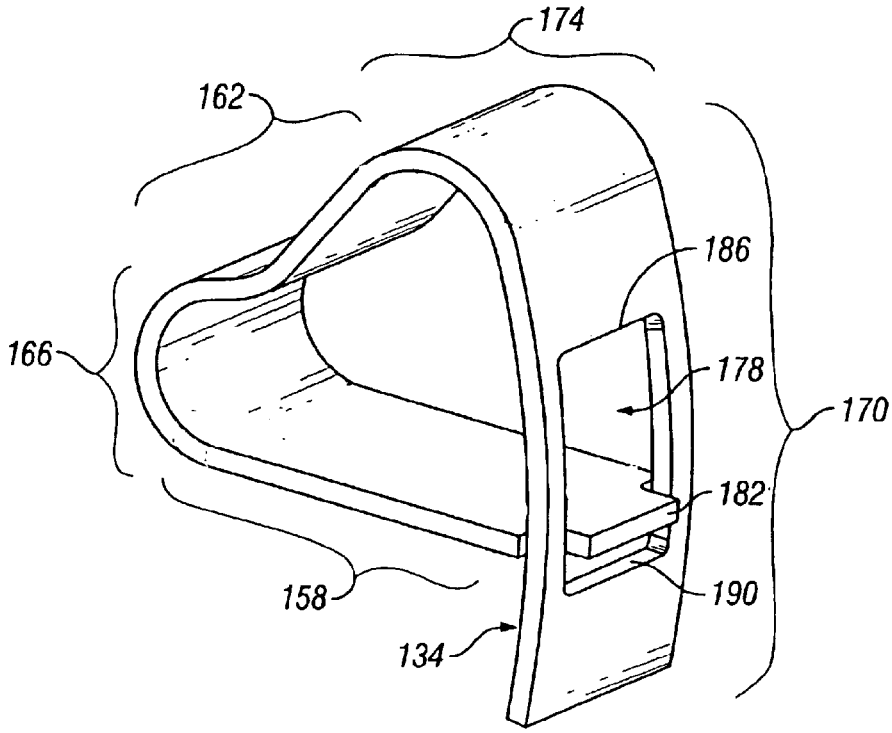
FIG. 6 illustrates an isometric view of a spring clamp formed according to an embodiment of the present invention.

FIG. 6 illustrates an isometric view of the spring clamp 134 which may be made of a resilient material such as hard steel. The spring clamp 134 has a planar base 158 formed with a curved arm 162 at a flexible, rounded elbow 166. The arm 162 is formed with a beam portion 170 at a rounded corner 174. The beam portion 170 has a rectangular window 178 therethrough. The window 178 has a contact engaging edge 186 located opposite a wire engaging edge 190. The base 158 has a narrow tab 182 formed at an end opposite to the elbow 166. In a relaxed or uncompressed state, the tab 182 is received within the window 178 proximate the wire engaging edge 190. The beam portion 170 and the window 178 are movable in a clamping direction that is transverse or non-parallel to the actuator direction.

Figure 7:
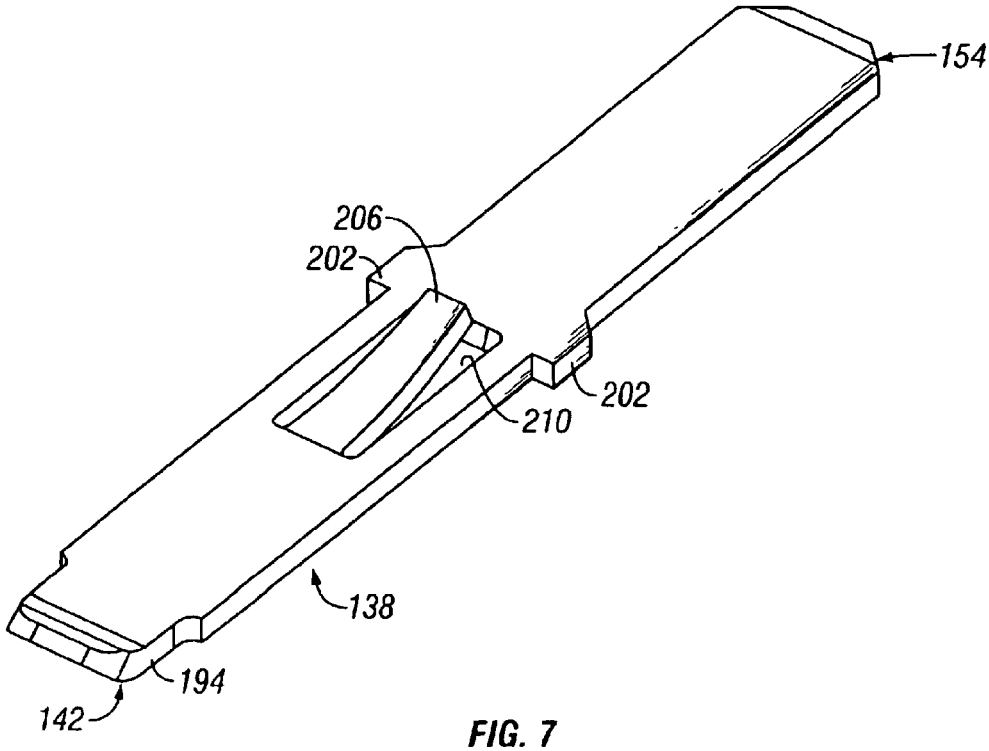
FIG. 7. illustrates an isometric view of a contact formed according to an embodiment of the present invention.

FIG. 7 illustrates an isometric view of the contact 138. The contact 138 is planar in shape and has an upturned, narrowed tab 194 at the first end 142 that is received in the window 178 (FIG. 6) of the spring clamp 134 (FIG. 6). The second end 154 of the contact 138 is configured to join the socket of the electronic component (not shown). The contact 138 also includes retention barbs 202 that extend from opposite sides thereof and a tine 206 that extends upward from a central portion of the contact 138 to form a gap 210 in the center of the contact 138.

Returning to FIG. 5, the contact 138 rests on a lower portion 214 of the housing 14 with the tine 206 engaging a ledge 218 in the interior wall 130. While not shown, the retention barbs 202 engage the interior wall 130 to retain the contact 138 within the chamber 118.

As shown in FIG. 5, the actuator 38 is supported within the channel 34 in the open position. The finger 94 of the actuator 38 extends between the top wall 80 and the interior wall 130. When the actuator 38 is in the open position as shown in FIG. 5, the seat 102 engages the spring clamp 134 at the corner 174 and compresses the spring clamp 134 downward in the direction of arrow B into an undamped state. As the spring clamp 134 is compressed, the beam portion 170 moves in a direction transverse to the contact 138 such that the window 178 is moved along the clamping direction into an aligned position with the passage 122 and the wire opening 26. Once the window 178 is in the unclamped state and aligned with the passage 122, a wire 42 (FIG. 3) may be freely inserted into the window 178 between the contact 138 and the wire engaging edge 190.

The spring clamp 134 is positioned such that the base 158 abuts the contact 138 and the elbow 166 of the spring clamp 134 abuts the interior wall 130. The tab 182 on the spring clamp 134 and the tab 194 on the contact 138 extend through the window 178 in the spring clamp 134. The tab 182 of the spring clamp 134 is located between the tab 194 of the contact 138 and the contact engaging edge 186. The beam portion 170 extends down into a beam channel 230 that extends through a bottom wall 126 of the housing 14. Thus, the actuator 38 compresses the spring clamp 134 such that the window 178 moves in the clamping direction about the tab 182 to the unclamped state.

Figure 8:
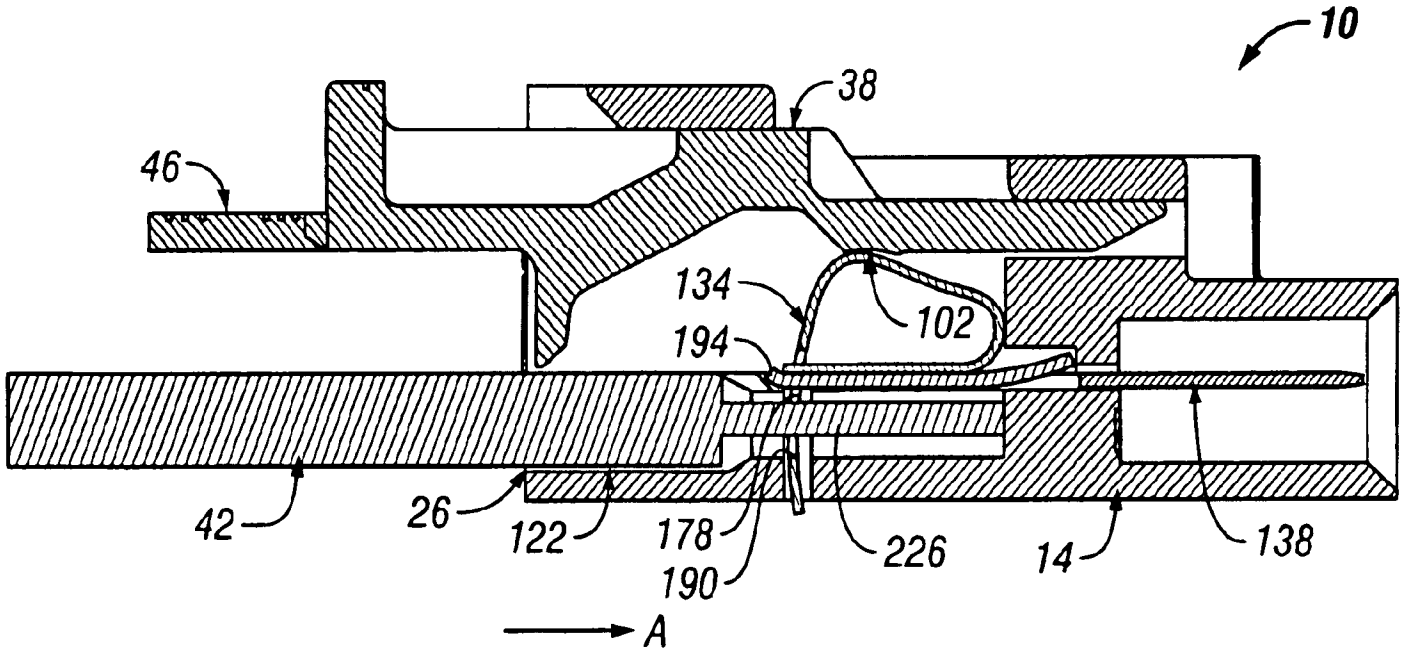
FIG. 8 illustrates a cross sectional view of the electrical connector of FIG. 5 with a wire inserted.

FIG. 8 illustrates a cross sectional view of the electrical connector 10 of FIG. 5 with the actuator 38 in the open position and with a wire 42 inserted. The scat 102 engages and compresses the spring clamp 134 in the unclamped state to hold the window 178 open and aligned with the passage 122 and the wire opening 26. Thus, the electrical connector 10 is pre-loaded in an open position for the operator to insert the wire 42 into the housing 14. The insulation of the wire 42 has been partially stripped to expose a conductor 226 within the wire 42. The wire 42 extends from an electronic component (not shown). The wire 42 is inserted into the wire opening 26 and the passage 122 in the direction of arrow A until the conductor 226 of the wire 42 passes through the window 178 of the spring clamp 134. The conductor 226 is positioned in the window 178 between the wire engaging edge 190 and the tab 194 of the contact 138.

The window 178 can then be closed about the conductor 226 by snapping the break-off tab 46 off of the actuator 38 and the housing 14. The actuator 38 is then moved in the direction of arrow A into the channel 34 to the closed position. The break-off tab 46 thus serves to prevent an operator from inadvertently moving the actuator 38 to the closed position prior to properly inserting the wire 42 into the housing 14.

Figure 9:
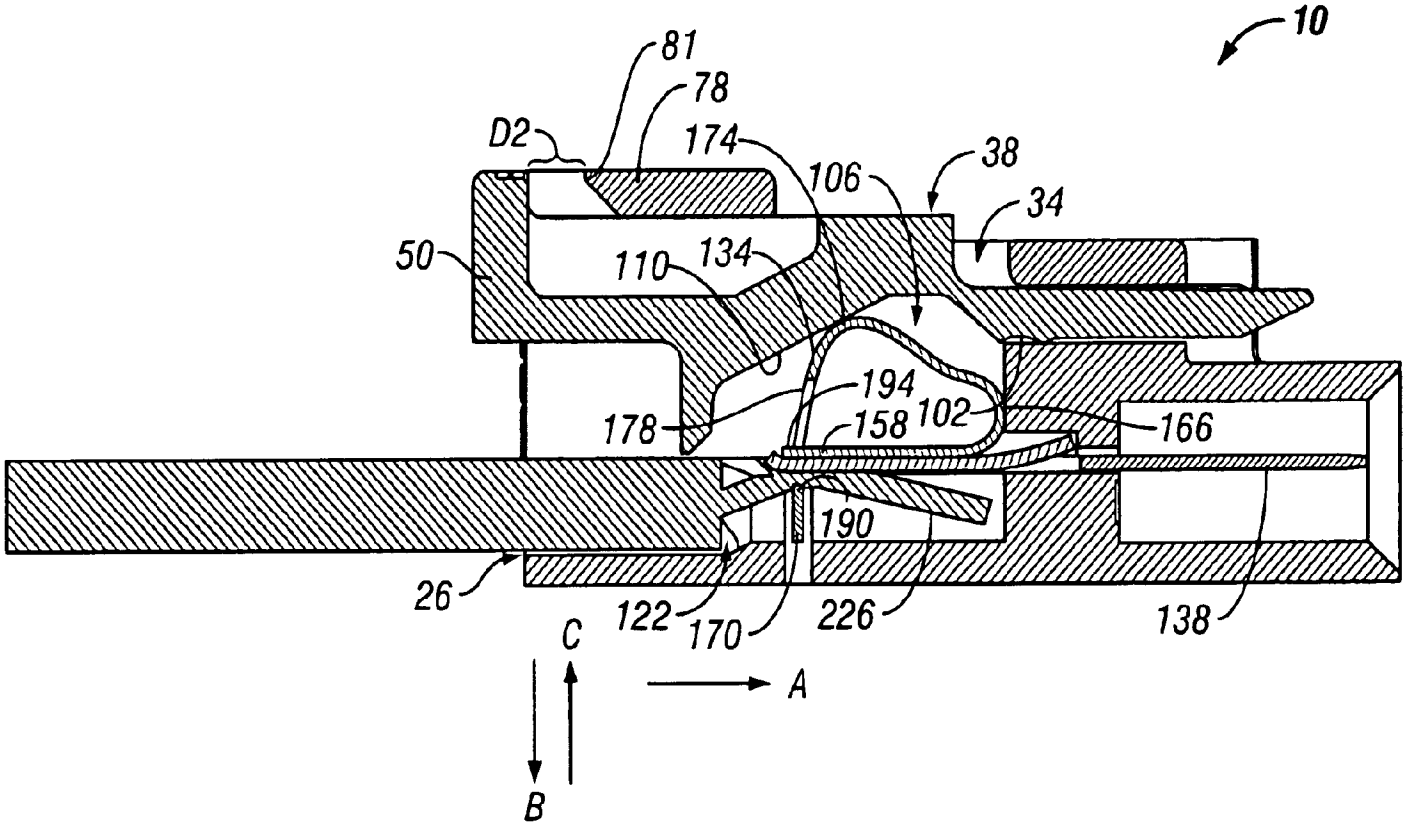
FIG. 9 illustrates a cross sectional view of the electrical connector of FIG. 2 taken along section line 9—9 in FIG. 2.

FIG. 9 illustrates a cross sectional view of the electrical connector 10 taken along section line 9—9 in FIG. 2 when in the closed position. As the actuator 38 is moved in the direction of arrow A along the actuator direction from the open position to the closed position, the seat 102 in the actuator 38 slides away from the corner 174 of the spring clamp 134 thereby permitting the spring clamp 134 to decompress. The spring clamp 134 expands into a clamped state as the notched out portion 106 of the actuator 38 receives the corner 174 of the spring clamp 134. The elbow 166 flexes the beam portion 170 generally upward in the direction of arrow C. As the beam portion 170 is moved in the direction of arrow C, the window 178 is carried along the clamping direction transverse to the contact 138 to a position offset from the wire opening 26 and the passage 122. As the window 178 moves in the direction of arrow C, the wire engaging edge 190 of the window 178 engages the conductor 226 and pinches the conductor 226 and the tab 194 of the contact 138 between the base 158 of the spring clamp 134 and the wire engaging edge 190. The conductor 226 thus engages the contact 138.

1421 The actuator 38 may continue to slide in the direction of arrow A even after the spring clamp 134 is fully decompressed into the clamped state until the ramped surface 110 engages the corner. 174 of the spring clamp 134. The spring clamp 134 resistibly engages the ramped surface 110 and prevents the actuator 38 from freely moving any further in the direction of arrow A. The actuator 38 is thus in the closed position with the stop 50 located the distance D2 from the rear edge 81 of the cover 78.

Figure 10:
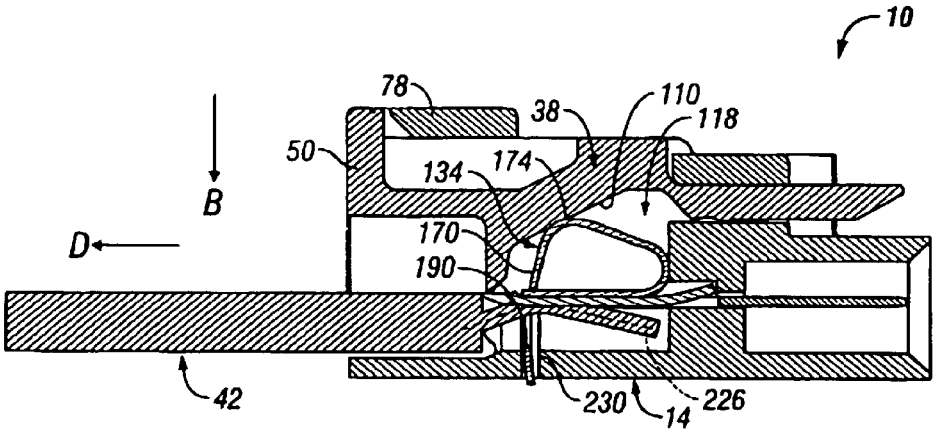
FIG. 10 illustrates a cross sectional view of the electrical connector of FIG. 3 taken along section line 10—10 in FIG. 3.

FIG. 10 illustrates a cross sectional view of the electrical connector 10 taken along section line 10—10 in FIG. 3 when in the repair position. When the actuator 38 is moved along the actuator direction into the repair position from the closed position, the stop 50 engages the cover 78 of the housing 14. As the actuator 38 is moved to the repair position, the ramped surface 110 engages the corner 174 of the spring clamp 134 and causes the spring clamp 134 to compress into the unclamped state such that the beam portion 170 moves generally downward in the direction of arrow B into the beam channel 230. As the beam portion 170 moves in the direction of arrow B, the window 178 moves into the aligned position and the wire engaging edge 190 moves away from, and releases, the conductor 226. Thus, the wire 42 is released within the chamber 118 and can be removed in the direction of arrow D from the housing 14 in order to repair the wire 42 or insert a new wire. The actuator 38 is held in the repair position while the wire 42 is removed. However, when the user or tool holding the actuator 38 in the repair position is released, the spring clamp 134 flexes back to its normal uncompressed position or clamped state and pushes the ramped surface 110 in the direction of arrow D. The actuator 38 is thus automatically moved back in the direction of arrow D by the spring clamp 134 to the closed position upon being released from the repair position. Hence, the ramped surface 110 provides a firm point of demarcation between the closed and repair positions.

Figure 11:
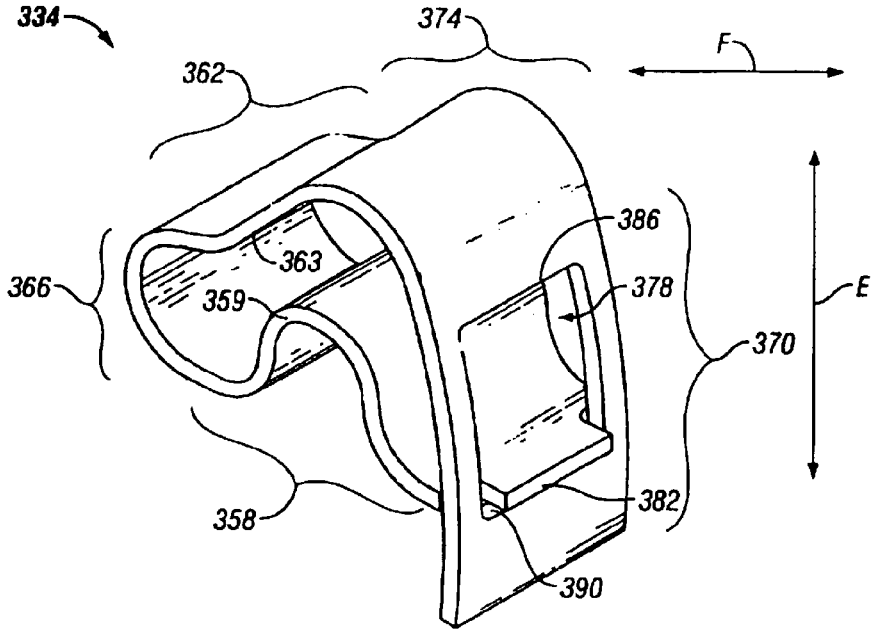
FIG. 11 illustrates an isometric view of a spring clamp formed in accordance with an alternative embodiment of the present invention.
Figure 12:
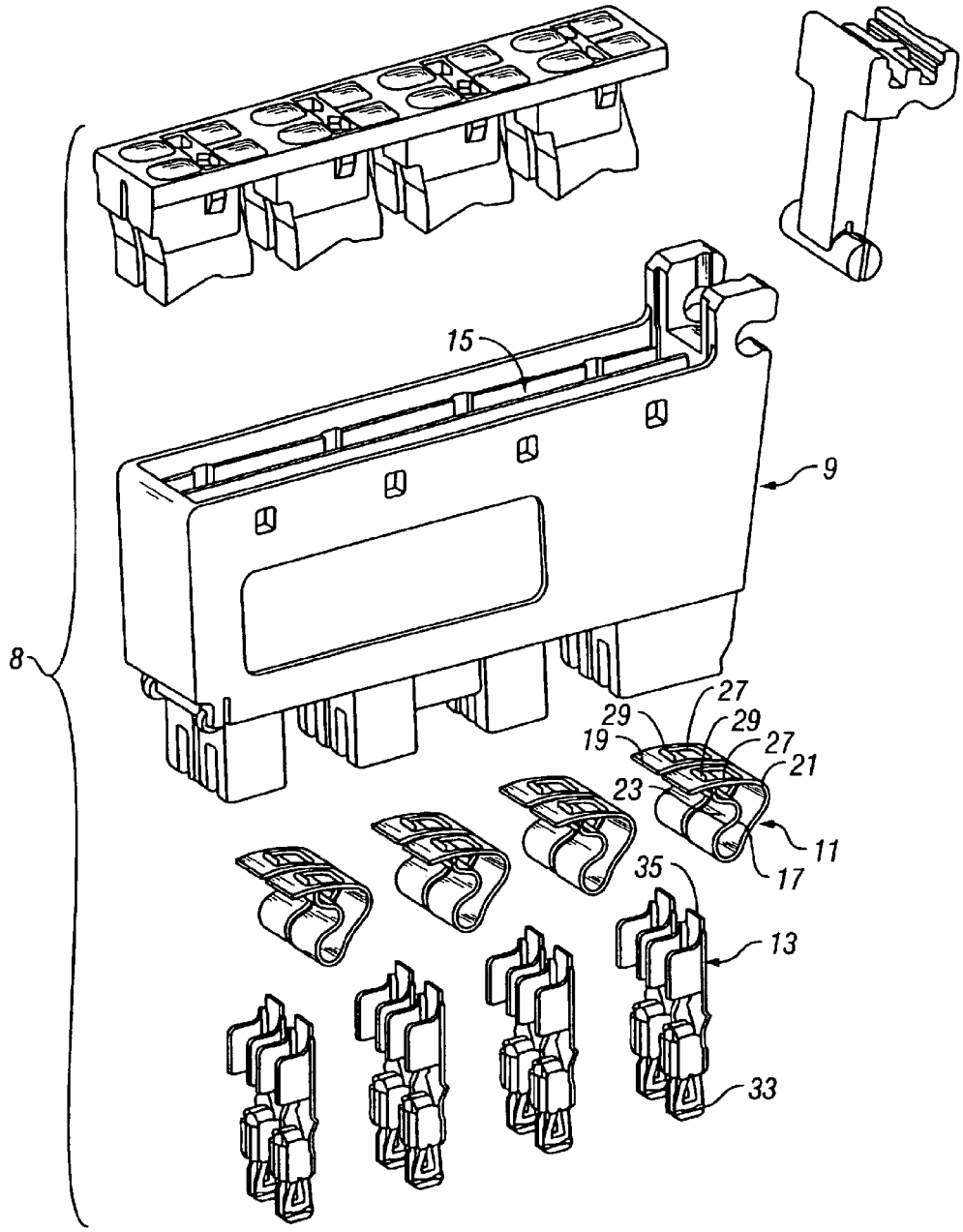
FIG. 12 (Prior Art)
FIG. 12 illustrates an exploded isometric view of a conventional electrical connector.
Figure 13:
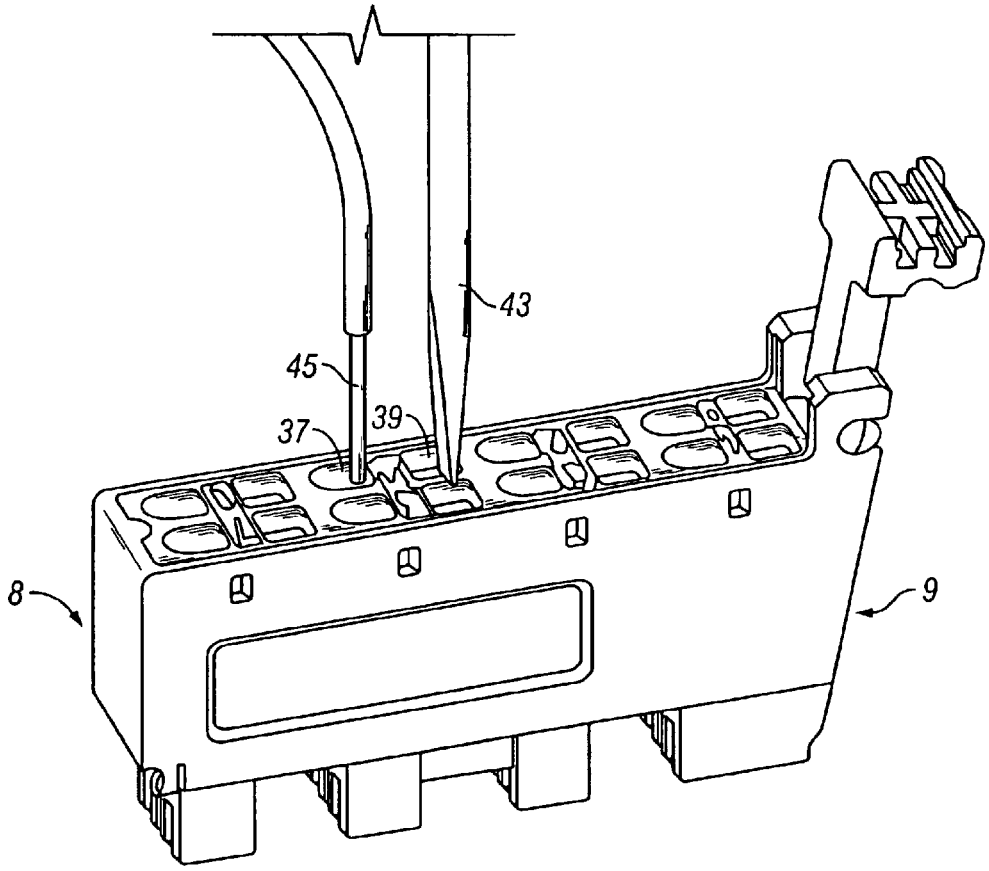
FIG. 13 (Prior Art)
FIG. 13 illustrates an isometric view of the electrical connector of FIG. 11 assembled.

FIG. 11 illustrates an isometric view of a spring clamp 334 formed in accordance with an alternative embodiment of the present invention. The spring clamp 334 has a base 358 that is formed with a curved arm 362 at a flexible, rounded elbow 366. The arm 362 is formed with a beam portion 370 at a rounded corner 374. The beam portion 370 has a rectangular window 378 therethrough. The window 378 has first and second edges 386 and 390 located opposite to one another. The base 358 has a narrow tab 382 formed at an end opposite to the elbow 366. In a relaxed or uncompressed state, the tab 382 is received within the window 378 proximate the second edge 390. The beam portion 370 and the window 378 are movable in a clamping direction (along arrow E) that is transverse or nonparallel to the actuator direction (along arrow F) similar to the manner explained above in connection with spring clamp 134 of FIG. 6.

The base 358 also includes a central raised portion 359 that is bent to extend upward toward the arm 362. The raised portion 359 abuts against a lower surface 363 of the arm 362 when the spring clamp 334 is fully compressed. The raised portion 359 serves as an anti-overstress member that prevent the spring clamp 334 from being excessively compressed to a point at which it is damaged.

In an alternative embodiment of the present invention, the actuators may be arranged within the housing such that the actuators are pulled out away from the housing to release the spring clamp into the notched out portion or engage the spring clamp with the ramped surface. Additionally, the actuators may be arranged to slide vertically within the housing along a vertical axis to engage the corners of the spring clamps. Thus, the actuators and the beam portions would move in the same linear direction as the actuators are moved to engage the spring clamps. Further, the housing may be configured to receive only one wire and actuator, or two wires and two actuators, or more than three wires and corresponding actuators. Also, the housing may be configured to carry only one actuator that engages multiple spring clamps to secure multiple wires within the housing.

The electrical connectors of the various embodiments provide several benefits. First, the use of an actuator to open, close, and re-open the spring clamp removes the need for an operator to insert a screwdriver into the housing and pry open the window of the resistant spring clamp while at the same time trying to insert a wire into the spring clamp. The spring clamp is closed simply by pushing the actuator inward toward the housing. The spring clamp may also be easily re-opened by pushing the actuator into a repair position that frees the wire from the spring clamp. The spring clamp may then be closed back about the wire by releasing the actuator from the repair position. Additionally, by preloading the spring clamp windows in the aligned position with the wire openings, an operator can insert the wires into the windows without using any tools or even moving the actuators. Finally, locking the actuators in the open position with the break-off tab prevents the operator from accidentally closing the windows prior to inserting the wires.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector, comprising:

a housing holding a contact, said housing having an opening configured to receive a wire to be joined with said contact;

a clamping member held within said housing, said clamping member being movable between clamped and unclamped states; and an actuator held within said housing, said actuator moving between open and closed positions, said actuator including a seat engaging and holding said clamping member in said unclamped state.

2. The electrical connector of claim 1, wherein said clamping member is compressible, said clamping member being decompressed when in said clamped state, and being compressed when in said unclamped state.

3. The electrical connector of claim 1, wherein said clamping member includes a beam portion having a window, said actuator moving said beam portion in a direction transverse to said contact such that said window moves into and out of alignment with said opening when said actuator is moved between said open and closed positions, respectively.

4. The electrical connector of claim 1, wherein said housing includes a passage configured to receive a wire and wherein said clamping member includes a beam portion with a window therein, said window having upper and lower edges opposing one another, said actuator moving said beam portion through said passage as said actuator moves said clamping member to said unclamped state to position said upper and lower edges along opposite sides of said passage.

5. The electrical connector of claim 1, wherein said actuator further comprises a notched out portion that receives said clamping member to permit said clamping member to move to said clamped state.

6. The electrical connector of claim 1, wherein said actuator further comprises a ramped surface that engages said clamping member when said actuator is moved from said closed position to a repair position that is separate and distinct from said open and closed positions.

7. The electrical connector of claim 1, wherein said actuator includes a clamp seating portion that compresses said clamping member into said unclamped state when said actuator is in said open position.

8. The electrical connector of claim 1, wherein said actuator is movable along a linear range of motion between open, closed and repair positions aligned successively with one another.

9. The electrical connector of claim 1, wherein said actuator includes a body portion extending from a rear edge of a cover of said housing, said body portion including a stop provided on an outer end thereof, said stop being spaced different first and second distances from said rear edge of said cover when said actuator is in said open and closed positions, respectively.

10. The electrical connector of claim 1, wherein said actuator includes a body portion extending from a rear edge of a cover of said housing, said body portion including a stop provided on an outer end thereof, said stop being spaced different first, second and third distances from said rear edge of said cover when said actuator is located in said open position, said closed position, and in a repair position, respectively, said repair position being separate and distinct from said open and closed positions.

11. The electrical connector of claim 1, wherein said clamping member constitutes a spring clamp having a base flexibly joined with a beam portion, said beam portion having a window therethrough, said actuator compressing said spring clamp to align said window with said opening in said housing.

12. The electrical connector of claim 1, wherein said clamping member includes a beam portion having a window therethrough and a base having a tab on one end thereof, said tab being received within said window, said beam portion being compressed by said actuator such that said window moves about said tab to said unclamped state.

13. The electrical connector of claim 1, wherein said housing includes a tab connected to said actuator and to said housing when said actuator is in said open position, said tab being removed from said actuator when said actuator is moved from said open position.

14. An electrical connector, comprising:

a housing having an opening configured to receive a wire;

a clamping member located in said housing, said clamping member including a window movable along a clamping direction between aligned and offset positions with respect to said opening; and an actuator held in said housing, said actuator being movable between open and closed positions in an actuator direction that is aligned non-parallel with said clamping direction of said clamping member, said actuator moving said window between said aligned and offset positions as said actuator is moved between said open and closed positions, respectively, and wherein said actuator is movable to a repair position, said actuator including a stop that is moved between different first, second, and third distances from said housing when said actuator is moved between said open, closed and repair positions, respectively.

15. The electrical connector of claim 14, wherein said actuator is movable to a repair position by a user and is automatically moved back from said repair position to said closed position upon being released by the user.

16. The electrical connector of claim 14, wherein said actuator is movable from said closed position to a repair position, said actuator including a ramped surface that compresses said clamping member to move said window into said aligned position when said actuator is moved from said closed position to said repair position, and wherein, when said clamping member decompresses, said clamping member returns said actuator to said closed position.

17. The electrical connector of claim 14, wherein said actuator is movable along a linear range of motion between open, closed and repair positions aligned successively with each other.

18. The electrical connector of claim 14, wherein said actuator includes a clamp seating portion that moves said clamping member to position said window is in said aligned position with said opening when said actuator is in said open position.

19. The electrical connector of claim 14, wherein said housing includes a tab connected to said actuator and connected to said housing when said actuator is in said open position, said tab being removed from said actuator when said actuator is moved from said open position.

20. An electrical connector, comprising:

a housing having an opening configured to receive a wire;

a clamping member located in said housing, said clamping member including a window movable along a clamping direction between aligned and offset positions with respect to said opening; and an actuator held in said housing, said actuator being movable between open and closed positions to move said window between said aligned and offset positions, respectively, said actuator including a finger extending through said housing to engage a channel block on said housing to limit a range of motion of said actuator.

* * * * *